US006902269B2

(12) United States Patent
Pan et al.

(10) Patent No.: US 6,902,269 B2
(45) Date of Patent: Jun. 7, 2005

(54) PROCESS FOR CURING MARKING COMPONENT WITH NANO-SIZE ZINC OXIDE FILLER

(75) Inventors: David H. Pan, Rochester, NY (US); Donald S. Stanton, Penfield, NY (US); Santokh S. Badesha, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 21 days.

(21) Appl. No.: 10/316,213

(22) Filed: Dec. 9, 2002

(65) Prior Publication Data

US 2004/0109057 A1 Jun. 10, 2004

(51) Int. Cl.[7] ..... B41J 3/407; B41J 2/01

(52) U.S. Cl. ..... 347/106; 347/103

(58) Field of Search ..... 399/325; 428/339, 428/375, 383, 391, 421, 422, 195, 212; 427/256, 387, 258, 261, 301, 333; 347/101–106, 85, 88, 99

(56) References Cited

U.S. PATENT DOCUMENTS 4,188,423 A * 2/1980 Swift ..... 427/444
4,517,342 A * 5/1985 Ryang ..... 525/431
4,728,687 A * 3/1988 Watanabe et al. ..... 524/493
5,292,606 A * 3/1994 Fitzgerald ..... 428/35.8
5,370,955 A * 12/1994 Toth et al. ..... 430/58.7
5,569,750 A * 10/1996 Knepper et al. ..... 524/731
5,645,888 A * 7/1997 Titterington et al. ..... 427/256
5,741,841 A * 4/1998 Badesha et al. ..... 524/379
5,753,307 A * 5/1998 Badesha et al. ..... 427/387
5,770,216 A * 6/1998 Mitchnick et al. ..... 428/402
6,295,434 B1 * 9/2001 Chang et al. ..... 399/297
6,348,552 B2 * 2/2002 Duvalsaint et al. ..... 526/227
6,355,352 B1 * 3/2002 Chen et al. ..... 428/421
6,680,279 B2 * 1/2004 Cai et al. ..... 502/327
6,689,474 B2 * 2/2004 Pickett et al. ..... 428/423.7

FOREIGN PATENT DOCUMENTS

JP 63243964 A * 10/1988 ..... G03G/9/08
JP 09096986 A * 4/1997 ..... G03G/15/20

* cited by examiner

*Primary Examiner*—Stephen D. Meier
*Assistant Examiner*—An H. Do
(74) *Attorney, Agent, or Firm*—Annette L. Bade

(57) ABSTRACT

A process for providing a layer on a marking member by dissolving a fluoroelastomer; adding and reacting a nano-size zinc oxide and a crosslinking agent, to form a resulting homogeneous fluoroelastomer dispersion, wherein the nano-size zinc oxide has a particle size of from about 1 to about 250 nanometers; and subsequently providing at least one layer of the homogeneous fluoroelastomer dispersion to the marking member.

17 Claims, 2 Drawing Sheets

PROCESS FOR CURING MARKING COMPONENT WITH NANO-SIZE ZINC OXIDE FILLER

CROSS REFERENCE TO RELATED APPLICATIONS

Reference is made to the following commonly assigned, copending patent application, U.S. patent application Ser. No. 10/316,234, filed Dec. 9, 2002, entitled, "Phase Change Ink Imaging Component with Nano-Size Filter." The disclosure of this patent application is hereby incorporated by reference in its entirety.

BACKGROUND OF THE INVENTION

The present invention relates generally to marking apparatuses and layers for components thereof, and for methods for preparation of the layers. The layers herein are useful for many purposes including layers for fusing components such as donor, fuser (i.e., heat fixing) and pressure components; transfer components such as transfix, transfuse or intermediate transfer components; imaging components; charging components; and like components. More specifically, the present invention relates to layers comprising nano-size fillers. The layers of the present invention may be useful in components used in combination with dry or liquid toners, inks, dyes, pigment-based materials, and the like. In embodiments, the layers can be used in combination with phase change inks such as solid inks, gel-based inks, ultraviolet curable inks, and other phase-change inks. In embodiments, nano-size zinc oxide is used as a curative for the layer. In embodiments, the layers comprise a fluoroelastomer.

Ink jet printing systems using intermediate transfer, transfix or transfuse members are well known, such as those described in U.S. Pat. No. 4,538,156. Generally, the printing or imaging member is employed in combination with a printhead. A final receiving surface or print medium is brought into contact with the imaging surface after the image has been placed thereon by the nozzles of the printhead. The image is then transferred and fixed to a final receiving surface.

More specifically, the phase-change ink imaging process begins by first applying a thin liquid, such as, for example, silicone oil, to an imaging member surface. The solid or hot melt ink is placed into a heated reservoir where it is maintained in a liquid state. This highly engineered ink is formulated to meet a number of constraints, including low viscosity at jetting temperatures, specific visco-elastic properties at component-to-media transfer temperatures, and high durability at room temperatures. Once within the printhead, the liquid ink flows through manifolds to be ejected from microscopic orifices through use of proprietary piezoelectric transducer (PZT) printhead technology. The duration and amplitude of the electrical pulse applied to the PZT is very accurately controlled so that a repeatable and precise pressure pulse can be applied to the ink, resulting in the proper volume, velocity and trajectory of the droplet. Several rows of jets, for example four rows, can be used, each one with a different color. The individual droplets of ink are jetted onto the liquid layer on the imaging member. The imaging member and liquid layer are held at a specified temperature such that the ink hardens to a ductile visco-elastic state.

After depositing the image, a print medium is heated by feeding it through a preheater and into a nip formed between the imaging member and a pressure member, either or both of which can also be heated. A high durometer synthetic pressure member is placed against the imaging member in order to develop a high-pressure nip. As the imaging member rotates, the heated print medium is pulled through the nip and is pressed against the deposited ink image with the help of a pressure member, thereby transferring the ink to the print medium. The pressure member compresses the print medium and ink together, spreads the ink droplets, and fuses the ink droplets to the print medium. Heat from the preheated print medium heats the ink in the nip, making the ink sufficiently soft and tacky to adhere to the print medium. When the print medium leaves the nip, stripper fingers or other like members, peel it from the printer member and direct it into a media exit path.

The imaging member is multi-functional. First, the ink jet printhead prints images on the imaging member, and thus, it is an imaging member. Second, after the images are printed on the imaging member, they can then transfixed or transfused to a final print medium. Therefore, the imaging member provides a transfix or transfuse function, in addition to an imaging function.

In order to ensure proper transfer and fusing of the ink off the imaging member to the print medium, certain nip temperature, pressure and compliance are required. Unlike laser printer imaging technology in which solid fills are produced by sheets of toner, the solid ink is placed on the imaging member one pixel at a time and the individual pixels must be spread out during the transfix process to achieve a uniform solid fill. Also, the secondary color pixels on the imaging member are physically taller than the primary color pixels because the secondary pixels are produced from two primary pixels. Therefore, compliance in the nip is required to conform around the secondary pixels and to allow the primary pixel neighbors to touch the media with enough pressure to spread and transfer. The correct amount of temperature, pressure and compliance is required to produce acceptable image quality.

Currently, the imaging member useful for solid inks or phase change inks comprises anodized aluminum. This member operates at about 57° C. to about 64° C. and can be used with a heater that preheats the print media prior to entering the nip. Otherwise, the imaging member may include a heater associated therewith. The heater may be associated anywhere on the offset printing apparatus. The current aluminum-imaging member has several drawbacks. A high nip load of up to about 770 pounds is needed for transfix or transfuse operations. Further, because of the high nip load, bulky mechanisms and supporting structures are needed, resulting in increased printer weight and cost. One example is that a fairly complex two-layer pressure roller is needed. In addition, the first copy out time is unacceptable because of the bulky weight. Moreover, low cohesive failure temperature is another drawback to use of an anodized aluminum drum.

Several coatings for the imaging member have been suggested. Examples are listed below.

U.S. Pat. No. 5,092,235 discloses a pressure fixing apparatus for ink jet inks having 1) outer shell of rigid, non-compliant material such as steel, or polymer such as acetal homopolymer or Nylon 6/6 and 2) an underlayer of elastomer material having a hardness of about 30 to 60, or about 50 to 60.

U.S. Pat. No. 5,195,430 discloses a pressure fixing apparatus for ink jet inks having 1) outer shell of rigid, non-compliant material such as steel, or polymer such as acetal homopolymer or Nylon 6/6 and 2) an underlayer of elastomer material having a hardness of about 30 to 60, or about 50 to 60, which can be polyurethane (VIBRATHANE, or REN:C:O-thane).

U.S. Pat. No. 5,389,958 discloses an intermediate transfer member/image receiving member having a surface of metal (aluminum, nickel, iron phosphate), elastomers (fluoroelastomers, perfluoroelastomers, silicone rubber, polybutadiene), plastics (polyphenylene sulfide), thermoplastics (polyethylene, polyamide (nylon), FEP), thermosets (metals, ceramics), and a pressure roller with elastomer surface.

U.S. Pat. No. 5,455,604 discloses a fixing mechanism and pressure wheels, wherein the pressure wheels can be comprised of a steel or plastic material such as DELRIN. Image-receiving drum 40 can be a rigid material such as aluminum or stainless steel with a thin shell mounted to the shaft, or plastic.

U.S. Pat. No. 5,502,476 teaches a pressure roller having a metallic core with elastomer coating such as silicones, urethanes, nitriles, or EPDM, and an intermediate transfer member surface of liquid, which can be water, fluorinated oils, glycol, surfactants, mineral oil, silicone oil, functional oils such as mercapto silicone oils or fluorinated silicone oils or the like, or combinations thereof.

U.S. Pat. No. 5,614,933 discloses an intermediate transfer member/image receiving member having a surface of metal (aluminum, nickel, iron phosphate), elastomers (fluoroelastomers, perfluoroelastomers, silicone rubber, polybutadiene), plastics (polyphenylene sulfide), thermoplastics (polyethylene, polyamide (nylon), FEP), thermosets (metals, ceramics), or polyphenylene sulfide loaded with PTFE, and a pressure roller with elastomer surface.

U.S. Pat. No. 5,790,160 discloses an intermediate transfer member/image receiving member having a surface of metal (aluminum, nickel, iron phosphate), elastomers (fluoroelastomers, perfluoroelastomers, silicone rubber, polybutadiene), plastics (polyphenylene sulfide), thermoplastics (polyethylene, polyamide (nylon), FEP), thermosets (metals, ceramics), or polyphenylene sulfide loaded with PTFE, and a pressure roller with elastomer surface.

U.S. Pat. No. 5,805,191 an intermediate transfer member/image receiving member having a surface of metal (aluminum, nickel, iron phosphate), elastomers (fluoroelastomers, perfluoroelastomers, silicone rubber, polybutadiene), plastics (polyphenylene sulfide), thermoplastics (polyethylene, polyamide (nylon), FEP), thermosets (metals, ceramics), or polyphenylene sulfide loaded with PTFE, and an outer liquid layer of liquid, which can be water, fluorinated oils, glycol, surfactants, mineral oil, silicone oil, functional oils such as mercapto silicone oils or fluorinated silicone oils or the like, or combinations thereof.

U.S. Pat. No. 5,808,645 discloses a transfer roller having a metallic core with elastomer covering of silicone, urethanes, nitriles, and EPDM.

U.S. Pat. No. 6,196,675 B1 discloses separate image transfer and fusing stations, wherein the fuser roller coatings can be silicones, urethanes, nitrites and EPDM.

U.S. Pat. No. 5,777,650 discloses a pressure roller having an elastomer sleeve, and an outer coating that can be metals, (aluminum, nickel, iron phosphate), elastomers (fluoroelastomers, perfluoroelastomers, silicone rubber, polybutadiene), plastics (polyphenylene sulfide with PTFE filler), thermoplastics (polyethylene, polyamide (nylon), FEP), thermosets (acetals, ceramics). Preferred is anodized aluminum.

In addition, many different types of outer coatings for transfer members, fuser members, and intermediate transfer members have been used in the electrostatographic arts using powder toner, but not with liquid inks or phase change inks. Several examples are listed herein.

U.S. Pat. No. 5,361,126 discloses an imaging apparatus including a transfer member including a heater and pressure-applying roller, wherein the transfer member includes a fabric substrate and an impurity-absorbent material as a top layer. The impurity-absorbing material can include a rubber elastomer material.

U.S. Pat. No. 5,337,129 discloses an intermediate transfer component comprising a substrate and a ceramer or grafted ceramer coating comprised of integral, interpenetrating networks of haloelastomer, silicon oxide, and optionally polyorganosiloxane.

U.S. Pat. No. 5,340,679 discloses an intermediate transfer component comprised of a substrate and thereover a coating comprised of a volume grafted elastomer, which is a substantially uniform integral interpenetrating network of a hybrid composition of a fluoroelastomer and a polyorganosiloxane.

U.S. Pat. No. 5,480,938 describes a low surface energy material comprising a volume grafted elastomer which is a substantially uniform integral interpenetrating network of a hybrid composition of a fluoroelastomer and a polyorganosiloxane, the volume graft having been formed by dehydrofluorination of fluoroelastomer by a nucleophilic dehydrofluorinating agent, followed by a hydrosilation reaction, addition of a hydrogen functionally terminated polyorganosiloxane and a hydrosilation reaction catalyst U.S. Pat. No. 5,366,772 describes a fuser member comprising a supporting substrate, and a outer layer comprised of an integral interpenetrating hybrid polymeric network comprised of a haloelastomer, a coupling agent, a functional polyorganosiloxane and a crosslinking agent.

U.S. Pat. No. 5,456,987 discloses an intermediate transfer component comprising a substrate and a titamer or grafted titamer coating comprised of integral, interpenetrating networks of haloelastomer, titanium dioxide, and optionally polyorganosiloxane.

U.S. Pat. No. 5,848,327 discloses an electrode member positioned near the donor member used in hybrid scavengeless development, wherein the electrode members have a composite haloelastomer coating.

U.S. Pat. No. 5,576,818 discloses an intermediate toner transfer component including: (a) an electrically conductive substrate; (b) a conformable and electrically resistive layer comprised of a first polymeric material; and (c) a toner release layer comprised of a second polymeric material selected from the group consisting of a fluorosilicone and a substantially uniform integral interpenetrating network of a hybrid composition of a fluoroelastomer and a polyorganosiloxane, wherein the resistive layer is disposed between the substrate and the release layer.

U.S. Pat. No. 6,035,780 discloses a process for forming a layer on a component of an electrostatographic apparatus, including mixing a first fluoroelastomer and a polymeric siloxane containing free radical reactive functional groups, and forming a second mixture of the resulting product with a mixture of a second fluoroelastomer and a second polysiloxane compound.

U.S. Pat. No. 5,537,194 discloses an intermediate toner transfer member comprising: (a) a substrate; and (b) an outer layer comprised of a haloelastomer having pendant hydrocarbon chains covalently bonded to the backbone of the haloelastomer.

U.S. Pat. No. 5,753,307 discloses fluoroelastomer surfaces and a method for providing a fluoroelastomer surface on a supporting substrate which includes dissolving a fluoroelastomer; adding a dehydrofluorinating agent; adding an amino silane to form a resulting homogeneous fluoroelastomer solution; and subsequently providing at least one layer of the homogeneous fluoroelastomer solution to the supporting substrate.

U.S. Pat. No. 5,840,796 describes polymer nanocomposites including a mica-type layered silicate and a fluoroelastomer, wherein the nanocomposite has a structure selected from the group consisting of an exfoliated structure and an intercalated structure.

U.S. Pat. No. 5,846,643 describes a fuser member for use in an electrostatographic printing machine, wherein the fuser member has at least one layer of an elastomer composition comprising a silicone elastomer and a mica-type layered silicate, the silicone elastomer and mica-type layered silicate form a delaminated nanocomposite with silicone elastomer inserted among the delaminated layers of the mica-type layered silicate.

U.S. Pat. No. 5,933,695 discloses a rapid wake up fuser member comprising a substrate, a heat transmissive layer provided on the substrate and having a silicone material and a Q-resin, and a toner release layer comprising a polymer and provided on the heat transmissive layer.

U.S. Pat. No. 4,853,737 discloses rollers having an outer layer comprising a cured fluoroelastomer containing pendant polydiorganosiloxane units that are covalently bonded to the backbone of the fluoroelastomer.

Processes for curing fluoroelastomer materials have been described in patents.

U.S. Pat. No. 5,753,307 discloses fluoroelastomer surfaces and a method for providing a fluoroelastomer surface on a supporting substrate which includes dissolving a fluoroelastomer; adding a dehydrofluorinating agent; adding an amino silane to form a resulting homogeneous fluoroelastomer solution; and subsequently providing at least one layer of the homogeneous fluoroelastomer solution to the supporting substrate.

U.S. Pat. No. 5,750,204 discloses fluoroelastomer surfaces and a method for providing a fluoroelastomer surface on a supporting substrate which includes dissolving a solid fluoroelastomer in a solvent, adding an amino silane in order to effect coupling and crosslinking and to form a resulting homogeneous fluoroelastomer solution, and subsequently providing a layer of the homogeneous fluoroelastomer solution to the supporting substrate is provided herein.

U.S. Pat. No. 5,744,200 discloses volume grafted elastomer surfaces and a method for providing a volume grafted elastomer surface on a supporting substrate which includes dissolving a fluoroelastomer in a solvent, adding a nucleophilic dehydrofluorinating agent, preferably an amino silane which acts as both a dehydrofluorinating agent and curing agent, a polymerization initiator and a polyorganosiloxane in amounts sufficient to effect formation of a volume graft elastomer, optionally adding an additional amount of amino silane as a curative in order to ensure complete curing of the volume grafted elastomer, and subsequently providing a layer of the homogeneous volume grafted elastomer solution to the supporting substrate are provided herein.

U.S. Pat. No. 5,695,878 discloses fluoroelastomer surfaces for fuser members and a method for fusing thermoplastic resin toner images to a substrate using fuser surfaces, including a method for forming these surfaces which includes dissolving a fluoroelastomer; adding an amino silane to form a resulting homogeneous fluoroelastomer solution; and subsequently providing a layer of the homogeneous fluoroelastomer solution to the supporting substrate.

U.S. Pat. No. 5,700,568 discloses fluoroelastomer surfaces for fuser members and a method for fusing thermoplastic resin toner images to a substrate using fuser surfaces, including a method for forming these surfaces which includes dissolving a fluoroelastomer; adding an amino silane to form a resulting homogeneous fluoroelastomer solution; and subsequently providing a layer of the homogeneous fluoroelastomer solution to the supporting substrate.

Some elastomer coatings have been shown to provide a multi-functional imaging member for use with phase change ink printing machines, which has the ability to receive an image, and either transfer, or transfer and fuse the image to a print medium. In addition, the imaging member having embodiments of elastomer coatings, has also been shown to be thermally stable for conduction for fusing or fixing. Moreover, the imaging member having certain elastomer coatings has been shown to have a relatively low nip load, in order to decrease the weight and cost of the printing machine, and in order to provide an acceptable first copy out time. Also, the elastomers enable low load, high temperature process for low unit manufacturing costs, and high speed printing. Further, some elastomers have been shown to increase print quality.

However, some disadvantages of the elastomeric imaging member coatings include the life shortfall versus the hard anodized component counterpart. The shortfall could be due to coating wear, peel-off from the imaging member substrate, external scratches, or other reasons. In addition, improvements need to be made to gloss life. Further, transfix loads are relatively high and it is expensive to make the above members. The current 770-pound nominal load requires bulky mechanisms and supporting structures, which increases printer weight and cost. It has been estimated that at least $100.00 could be saved by reducing the transfix loads down to about 100 pounds. Reduced load would also allow for reduced printer weight and reduced warm-up time, both of which are critical to the continued success of the technology.

Therefore, it is desired to provide a coating for an imaging member, which has the above superior qualities of elastomeric coatings, such as a compliant coating which dispenses with the need for an expensive two-layer coating, and which has an increased wear and life. It is further desired to provide improved surface wear resistance and improved gloss maintenance life against paper abrasion. In addition, it is desired to provide a coating with control over surface roughness and with a lower coefficient of friction. It is further desired to provide an outer coating which increases transfix speed and print quality. Moreover, providing a coating which results in reductions in load is highly desirable, as is increased high temperature release capabilities. Also, providing a coating which results in a decrease or elimination of the requirement of preheating of the copy substrate, such as paper, is desired. It is further desired to provide a curing process that can be used to cure layers for other marking components of not only phase change ink machines, but electrostatographic, electrophotographic, xerographic, and other marking machines.

SUMMARY OF THE INVENTION

The present invention provides, in embodiments, a process for providing a layer on a marking member comprising dissolving a fluoroelastomer; adding and reacting a nano-size zinc oxide and a crosslinking agent, to form a resulting homogeneous fluoroelastomer dispersion, wherein the nano-size zinc oxide has a particle size of from about 1 to about 250 nanometers; and subsequently providing at least one layer of the homogeneous fluoroelastomer dispersion to the marking member.

The present invention further provides, in embodiments, a process for providing a layer on a marking member comprising a) dissolving a fluoroelastomer; b) adding and reacting a nano-size zinc oxide and a crosslinking agent comprising a bisphenol material and a phosphonium salt, to form a resulting homogeneous fluoroelastomer dispersion, wherein the nano-size zinc oxide has a particle size of from about 1 to about 250 nanometers; and c) subsequently providing at least one layer of the homogeneous fluoroelastomer dispersion to the marking member.

The process further provides, in embodiments, a process for providing a layer on a marking member comprising a) dissolving a fluoroelastomer; b) adding and reacting a nano-size zinc oxide in an amount of from about 1 to about 50 pph of the fluoroelastomer, and a crosslinking agent comprising a bisphenol material and a phosphonium bisphenol salt, to form a resulting homogeneous fluoroelastomer dispersion, wherein the nano-size zinc oxide has a particle size of from about 1 to about 250 nanometers; and c) subsequently providing at least one layer of the homogeneous fluoroelastomer dispersion to the marking member.

A process for provides, in embodiments, a layer on an offset printing member, wherein the offset printing member comprises a phase change ink component for applying a phase change ink in a phase change ink image, and an imaging member for accepting the phase change ink image from the phase change ink component, and transferring the phase change ink image from the imaging member to the print medium, the process comprising: a) dissolving a fluoroelastomer; b) adding and reacting a nano-size zinc oxide and a crosslinking agent, to form a resulting homogeneous fluoroelastomer dispersion, wherein the nano-size zinc oxide has a particle size of from about 1 to about 250 nanometers; and c) subsequently providing at least one layer of the homogeneous fluoroelastomer dispersion to the imaging member.

BRIEF DESCRIPTION OF THE DRAWINGS

The above embodiments of the present invention will become apparent as the following description proceeds upon reference to the drawings, which include the following figures.

DETAILED DESCRIPTION OF THE INVENTION

The present invention is directed to a marking apparatus useful with dry or liquid inks, and phase-change inks such as solid inks, and comprising a coated marking member. The present invention further relates to a method for curing an outer marking member layer using nano-size zinc oxide as the curative. In embodiments, the nano-size zinc oxide is used to cure a fluoroelastomer outer layer material. The marking member can be a roller such as a drum, or a film component such as a film, sheet, belt or the like. In embodiments, the marking member comprises a substrate and an outer layer comprising nano-size fillers dispersed or contained in the outer layer. In an alternative embodiment, the marking member comprises a substrate, an optional intermediate layer, and outer layer comprising nano-size fillers dispersed or contained in the outer layer. The substrate, and/or intermediate layer may also comprise other fillers, and even additional nano-size fillers, dispersed or contained therein.

Embodiments of the present invention will be described. It should be understood that the present application is not limited to one specific marking member. What follows is a description of one embodiment of the invention, which includes a phase change ink imaging marking member. The details of embodiments of phase-change ink printing processes are described in the patents referred to above, such as U.S. Pat. Nos. 5,502,476; 5,389,958; and 6,196,675 B1, the disclosures of each of which are hereby incorporated by reference in their entirety. An example of one embodiment of a phase-change ink printing process is set forth below. It should be understood that the marking member can be used with xerographic, electrophotographic, or electrostatographic apparatuses.

Figure 1:
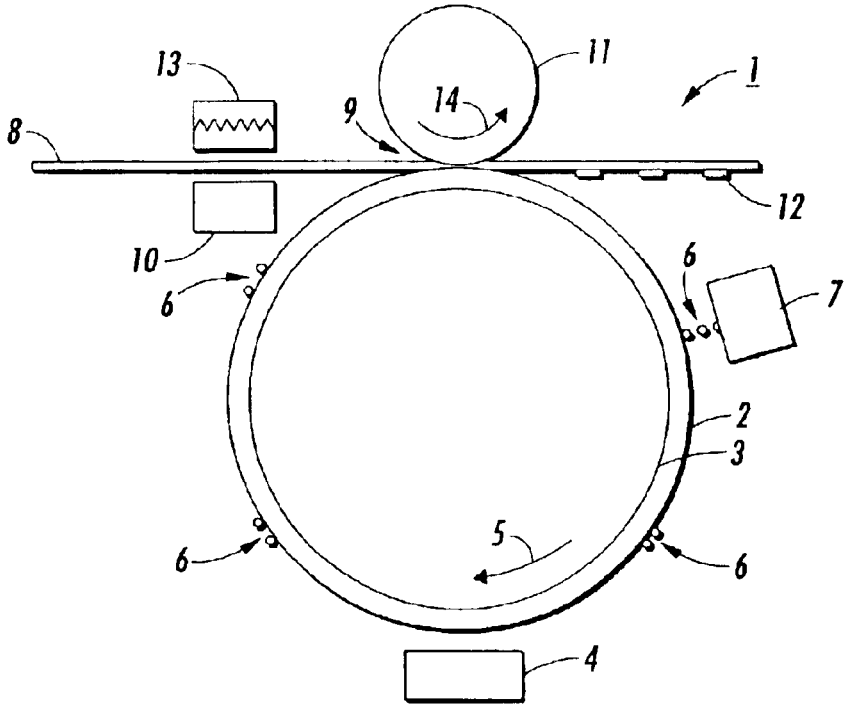
FIG. 1 is an illustration of an embodiment of the invention, and includes a transfer printing apparatus using an imaging member in the form of a drum.

Referring to FIG. 1, offset printing apparatus 1 is demonstrated to show transfer of an ink image from the imaging member to a final printing medium or receiving substrate. As the imaging member 3 turns in the direction of arrow 5, a liquid surface 2 is deposited on imaging member 3. The imaging member 3 is depicted in this embodiment as a drum member. However, it should be understood that other embodiments can be used, such as a belt member, film member, sheet member, or the like. The liquid layer 2 is deposited by an applicator 4 that may be positioned at any place, as long as the applicator 4 has the ability to make contact and apply liquid surface 2 to imaging member 3.

The ink used in the printing process can be a phase change ink, such as, for example, a solid ink. The term "phase change ink" means that the ink can change phases, such as a solid ink becoming liquid ink or changing from solid into a more malleable state. Specifically, in embodiments, the ink can be in solid form initially, and then can be changed to a molten state by the application of heat energy. The solid ink may be solid at room temperature, or at about 25° C. The solid ink may possess the ability to melt at relatively high temperatures above from about 85° C. to about 150° C. The ink is melted at a high temperature and then the melted ink 6 is ejected from printhead 7 onto the liquid layer 2 of imaging member 3. The ink is then cooled to an intermediate temperature of from about 20° C. to about 80° C., or about 72° C., and solidifies into a malleable state in which it can then be transferred onto a final receiving substrate 8 or print medium 8.

The ink has a viscosity of from about 5 to about 30 centipoise, or from about 8 to about 20 centipoise, or from about 10 to about 15 centipoise at about 140° C. The surface tension of suitable inks is from about 23 to about 50 dynes/cm. Examples of a suitable inks for use herein include those described in U.S. Pat. Nos. 4,889,560; 5,919,839; 6,174,937; and 6,309,453, the disclosure each of which are hereby incorporated by reference in their entirety.

Some of the liquid layer 2 is transferred to the print medium 8 along with the ink. A typical thickness of transferred liquid is about 100 angstroms to about 100 nanometer, or from about 0.1 to about 200 milligrams, or from about 0.5 to about 50 milligrams, or from about 1 to about 10 milligrams per print medium.

Suitable liquids that may be used as the print liquid surface 2 include water, fluorinated oils, glycol, surfactants, mineral oil, silicone oil, functional oils, and the like, and mixtures thereof. Functional liquids include silicone oils or polydimethylsiloxane oils having mercapto, fluoro, hydride, hydroxy, and the like functionality.

Feed guide(s) 10 and 13 help to feed the print medium 8, such as paper, transparency or the like, into the nip 9 formed between the pressure member 11 (shown as a roller), and imaging member 3. It should be understood that the pressure member can be in the form of a belt, film, sheet, or other form. In embodiments, the print medium 8 is heated prior to entering the nip 9 by heated feed guide 13. When the print medium 8 is passed between the printing medium 3 and the pressure member 11, the melted ink 6 now in a malleable state is transferred from the imaging member 3 onto the print medium 8 in image configuration. The final ink image 12 is spread, flattened, adhered, and fused or fixed to the final print medium 8 as the print medium moves between nip 9. Alternatively, there may be an additional or alternative heater or heaters (not shown) positioned in association with offset printing apparatus 1. In another embodiment, there may be a separate optional fusing station located upstream or downstream of the feed guides.

The pressure exerted at the nip 9 is from about 10 to about 1,000 psi., or about 500 psi, or from about 200 to about 500 psi. This is approximately twice the ink yield strength of about 250 psi at 50° C. In embodiments, higher temperatures, such as from about 72 to about 75° C. can be used, and at the higher temperatures, the ink is softer. Once the ink is transferred to the final print medium 8, it is cooled to an ambient temperature of from about 20° C. to about 25° C.

Stripper fingers (not shown) may be used to assist in removing the print medium 8 having the ink image 12 formed thereon to a final receiving tray (also not shown).

Although a specific application for the use of the invention for making layers for imaging members for phase change ink machines has been described, it should be appreciated that the present invention is not limited to layers for components for phase change ink machines, and can be used to provide layers for electrostatographic members using dry or liquid toner, and other marking machines.

Figure 2:
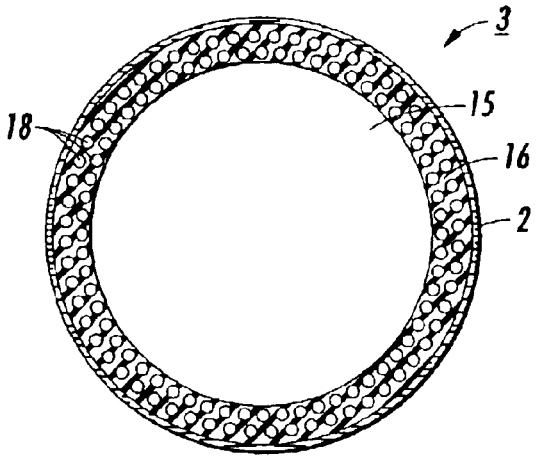
FIG. 2 is an enlarged view of an embodiment of a printing drum having a substrate and an outer layer thereon having nano-sized fillers dispersed or contained in the outer layer.

FIG. 2 demonstrates an embodiment of the invention, wherein a marking member 3 comprises substrate 15, having thereover outer coating 16 having nano-size zinc oxide fillers 18 dispersed or contained therein. In embodiments, an outer liquid layer 2 (as described above) may be present on the outer layer 16.

Figure 3:
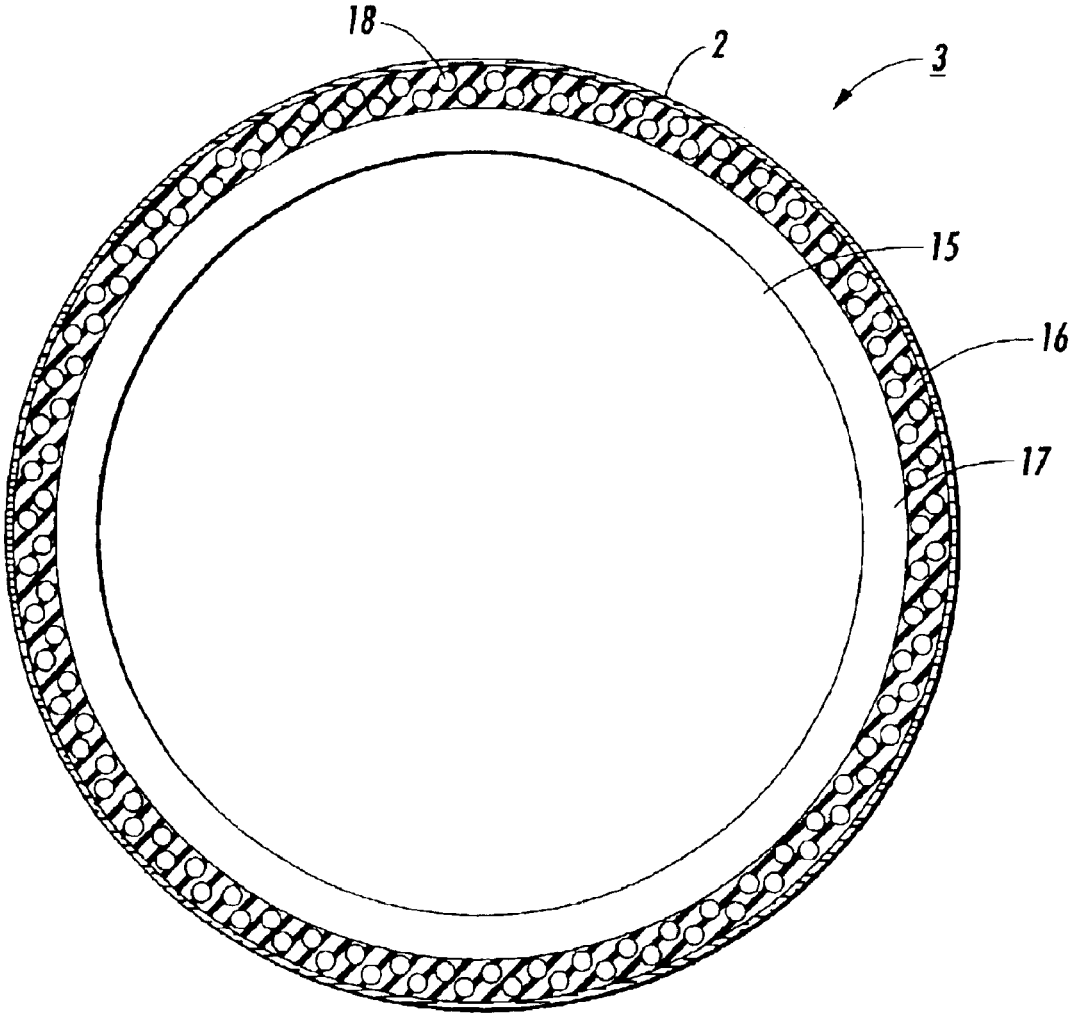
FIG. 3 is an enlarged view of an embodiment of a printing drum having a substrate, an optional intermediate layer, and an outer layer thereon having nano-sized fillers dispersed or contained in the outer layer.

FIG. 3 depicts another embodiment of the invention. FIG. 3 depicts a three-layer configuration comprising a substrate 15, intermediate layer 17 positioned on the substrate 15, and outer layer 16 positioned on the intermediate layer 17. Outer layer 16 comprises nano-size fillers 18 dispersed or contained therein. In embodiments, the substrate 15, and/or intermediate layer 16 may comprise nano-size fillers. In embodiments, an outer liquid layer 2 (as described above) may be present on the outer layer 16. In the Figures, the nano-size fillers are dramatically enlarged to show them.

In embodiments, the outer layer comprises an elastomer, such as a haloelastomer. Examples of elastomers comprising halogen monomers include chloroelastomers, fluoroelastomers and the like. Examples of fluoroelastomers include ethylenically unsaturated fluoroelastomers, and fluoroelastomers comprising copolymers and terpolymers of vinylidenefluoride, hexafluoropropylene and tetrafluoroethylene, which are known commercially under various designations as VITON A®, VITON B®, VITON E®, VITON F®, VITON E60C®, VITON E45®, VITON E430®, VITON B 910®, VITON GH®, VITON B50®, VITON E45®, and VITON GF®. The VITON® designation is a Trademark of E.I. DuPont de Nemours, Inc. Three known fluoroelastomers are (1) a class of copolymers of vinylidenefluoride, hexafluoropropylene and tetrafluoroethylene, known commercially as VITON A®, (2) a class of terpolymers of vinylidenefluoride, hexafluoropropylene and tetrafluoroethylene known commercially as VITON B®, and (3) a class of tetrapolymers of vinylidenefluoride, hexafluoropropylene, tetrafluoroethylene and a cure site monomer, for example, VITON® GF, VITON A®, and VITON B®. The cure site monomer can be those available from DuPont such as 4-bromoperfluorobutene-1, 1,1-dihydro-4-bromoperfluorobutene-1, 3-bromoperfluoropropene-1, 1,1-dihydro-3-bromoperfluoropropene-1, or any other suitable, known, commercially available cure site monomer.

In another embodiment, the fluoroelastomer is a tetrapolymer having a relatively low quantity of vinylidenefluoride. An example is VITON GF®, available from E.I. DuPont de Nemours, Inc. The VITON GF® has 35 weight percent of vinylidenefluoride, 34 weight percent of hexafluoropropylene, 29 weight percent of tetrafluoroethylene, with 2 weight percent cure site monomer.

Other fluoroelastomers that may be used include AFLAS®, FLUOREL® I, FLUOREL® II, TECHNOFLON® (such as TECHNOFLON® P959) and the like commercially available elastomers.

Nano-size zinc oxide is used as a curative in the process for forming an outer layer of a marking component. Examples of nano-size zinc oxide fillers include zinc oxide fillers having an average particle size of from about 1 to about 250 nanometers, or from about 5 to about 150 nanometers, or from about 10 to about 100 nanometers, or from about 24 to about 71 nanometers.

Other fillers such as micron-size fillers or nano-size fillers can be used in the present invention, in addition to the nano-size zinc oxide. Suitable micron-size or nano-size fillers include fillers such as metals, metal oxides, carbon blacks, polymers, and sol-gel particles, and mixtures thereof.

The nano-size zinc oxide can be a sol-gel zinc oxide, and can be grown inside the outer layer elastomer, in embodiments. The chemistry of the sol-gel process is shown below:

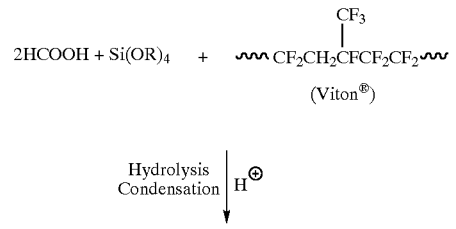

-continued

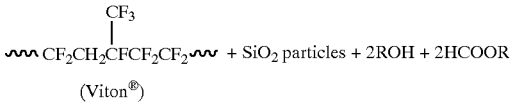

In the above scheme, R is $C_nH_{(2n+1)}$ (saturated, linear or branch) and n is a number of 2 or greater.

Examples of the zinc alkoxide compounds that can be used to form sol-gel ZnO nano-particles in flouroelastomer dispersions include zinc tert-butoxide, zinc ethylhexano-isopropoxide, zinc isopropoxide, zinc 2-methoxyethoxide, and the like.

In known processes for producing a layer for a component for a marking machine, a known filler is dissolved in an effective amount of a suitable solvent, such as an aliphatic hydrocarbon including for example methyl ethyl ketone, methyl isobutyl ketone, and the like, at any effective temperature, such as 25° C. Acetic acid catalyst is added in an effective amount, for example, from about 1 to about 15 percent by weight, or from about 3 to about 10 percent by weight relative to the weight of the elastomer, followed by stirring of the solution for about 15 to about 60 minutes at a temperature of about 45° C. to about 100° C. An effective amount of a silane compound such as tetraethoxyorthosilicate, for example, from about 1 to about 75 percent by weight, or from about 5 to about 50 percent by weight relative to the weight of elastomer, is then added and heating is continued at a temperature of about 4° C. to about 100° C. for an additional 20 minutes to about 10 hours. Any effective sequence of addition of the various components may be used to prepare this composition. For example, in embodiments, the elastomer may be added to a solvent already containing the acetic acid and/or the silane compound. The time of reaction is about 4 hours at about 65° C.

In embodiments, the known process to prepare the particles in an elastomer matrix may also include other components to facilitate the preparation thereof. For example, a nucleophilic curing agent for the elastomer such as VITON® Curative No. 50 and diamines such as Diak available from E.I. Dupont deNemours, Inc. may be employed at an effective concentration, such as from about 1 to about 15 percent by weight, or from about 2 to about 10 percent by weight, relative to the weight of the elastomer. VITON® Curative No. 50, which incorporates an accelerator (a quaternary phosphonium salt or salts) and a crosslinking agent, such as bisphenol AF in a single curative system, may be added in a 3 to 7 percent solution predissolved to the elastomer compound. Also, the basic oxides such as MgO and/or $Ca(OH)_2$ in effective amounts, such as from about 0.5 to about 10 percent by weight, or from about 1 to about 3 percent by weight, relative to the weight of the elastomer, may be added in particulate form to the solution mixture.

The above mixture including the curative and the oxides, is then ball milled for about 2 to about 24 hours or from about 5 to about 15 hours to obtain a fine dispersion of the oxides. The curative component can also be added after ball milling in a solution form. The solution of the curative is generally prepared by dissolving VITON® Curative No. 50 in methyl ethyl ketone ("MEK") or methyl isobutyl ketone ("MIBK"). The concentration of the solids, can vary from about 5 percent to about 25 percent by weight or from about 10 to about 15 percent by weight.

The process included in the present invention dispenses with the need for the basic oxides such as MgO and/or $Ca(OH)_2$ as curatives. Fluoroelastomers can be cured or chemically crosslinked to higher network content by use of a crosslinking agent such as known crosslinking agents, or those that may comprise a bisphenol and a phosphonium salt, in addition to nano-size zinc oxide. Other examples of crosslinking agents include Diak I, Diak III, and AO700. Examples of suitable crosslinking agents include VITON® Curative No. 50 (VC-50) which comprises a bisphenol AF and a phosphonium salt (such as benzyltriphenyl phosphonium bisphenol AF Salt from DuPont Dow Elastomers Co).

The crosslinking agent can be used in an amount of from about 0.5 to about 20 pph of the fluoroelastomer, or from about 1 to about 10 pph of the fluoroelastomer, or from about 3 to about 8 pph of the fluoroelastomer. The crosslinking agent can comprise a bisphenol material present in the crosslinking agent in an amount of from about 0 to about 90 percent, or from about 10 to about 70 percent by weight of total solids. The crosslinking agent can also comprises a phosphonium salt, which can be present in an amount of from about 10 to about 100 percent or from about 20 to about 70 percent by weight of total solids. The nano-size zinc oxide can be used in an amount of from about 1 to about 50 pph, or from about 3 to about 25 pph, or from about 5 to about 10 pph of the fluoroelastomer. Percentage by weight of total solids includes the total percentage (100%) of all solid materials in the outer layer, including the fluoroelastomer, phosphonium salt, bisphenol, zinc oxide, other fillers and additives, and like solid materials.

The particle size of the nano-size zinc oxide is much less than the particle size of the basic metal oxides MgO and/or $Ca(OH)_2$, which are routinely used in curing a fluoroelastomer. It has been discovered that by use of the nano-size zinc oxide, there is a higher degree of crosslinking or incorporation of the fluoroelastomer segment into the crosslinked network, than with the basic metal oxides as the curative.

The conventional base metal oxides such as MgO and $Ca(OH)_2$ are available in micron-size (approximately less than 1 micron). It was found that the wear of fluoroelastomer was often nucleated and propagated from the base metal oxide particles near the surface, resulting in a roughened surface. The rough surface resulted in decreased image gloss over the life of the imaging drum. It was also determined that it is extremely difficult to adequately disperse MgO and $Ca(OH)_2$ in fluoroelastomers, resulting in agglomerates of the base metal oxide, and thus reducing the VC-50 curative efficiency. These drawbacks are reduced or eliminated by use of nano-size zinc oxide as the curative package.

Providing the nano-size zinc oxide cured layer on the substrate may be accomplished by any suitable known method such as by spraying, dipping, flow, web or the like to a level of film of from about 10 to about 150 microns in thickness, or from about 50 to about 100 microns in thickness. The thickness of the overcoating is selected to provide a layer thick enough to allow a reasonable wear life. While molding, extruding and wrapping techniques are alternative means that may be used, in embodiments, flow coating of successive applications of the dispersion can be used. When the desired thickness of coating is obtained, the coating is cured, by any suitable known method, and thereby bonded to the surface. A typical step curing process for this method is heating for about 1 hour at from about 50 to about 75° C., followed by about 2 hours at about 95° C., followed by about 2 hours at about 145° C., followed by about 2 hours at about 175° C., followed by about 2 hours at about 205° C., followed by about 16 hours at about 232° C.

The nano-size fillers provide antistatic properties to the outer layer in a highly conductive range of from about $10^4$ to about $10^{12}$ ohm-cm, or from about $10^8$ to about $10^{10}$ ohm-cm.

Superior crosslinking is achieved by use of the nano-size zinc oxide as a curative. The percent extractables from an outer layer cured with nano-size zinc oxide is from about 0.1 to about 3, or from about 1 to about 2 percent.

The release capability is often measured by the cohesive failure temperature. It is estimated that the release capability is the same for nano-size and base metal oxides. Pre-heat temperatures is one of the print process critical parameters. Pre-heat temperature for most of the nano-size fillers has been found to be about 65° C. for testing different drum coatings.

The marking substrate can comprise any material having suitable strength for use as a marking member substrate. Examples of suitable materials for the substrate include metals, fiberglass composites, rubbers, and fabrics. Examples of metals include steel, aluminum, nickel, and their alloys, and like metals, and alloys of like metals. The thickness of the substrate can be set appropriate to the type of marking member employed. In embodiments wherein the substrate is a belt, film, sheet or the like, the thickness can be from about 0.5 to about 500 mils, or from about 1 to about 250 mils. In embodiments wherein the substrate is in the form of a drum, the thickness can be from about 1/32 to about 1 inch, or from about 1/16 to about 5/8 inch.

Examples of suitable marking substrates include a sheet, a film, a web, a foil, a strip, a coil, a cylinder, a drum, an endless strip, a circular disc, a belt including an endless belt, an endless seamed flexible belt, an endless seamless flexible belt, an endless belt having a puzzle cut seam, a weldable seam, and the like.

In an optional embodiment, an intermediate layer may be positioned between the marking substrate and the outer layer. Materials suitable for use in the intermediate layer include silicone materials, elastomers such as fluoroelastomers, fluorosilicones, ethylene propylene diene rubbers, and the like, and mixtures thereof. In embodiments, the intermediate layer is conformable and is of a thickness of from about 2 to about 60 mils, or from about 4 to about 25 mils.

The nano-size filled coating has the superior qualities of the elastomeric coatings, and also increased wear and life. The nano-size filled coating also provides improved surface wear resistance and improved gloss maintenance life against paper abrasion. Further, reduced transfix load of from about 770 pounds down to from about 100 to about 300 pounds, has been shown by use of the nano-size zinc oxide cured fluoroelastomer layer. In addition, increased transfix drum temperature release capability of from about 57° C. formerly without the nano-size zinc oxide, to about 80° C. with the nano-size zinc oxide curative, has been shown. This, in turn, reduces the requirement of paper preheat. Moreover, by use of the nano-size zinc oxide cured fluoroelastomer coating, a 25 ips transfix speed and print quality of a phase change ink product can be demonstrated. Further, the use of a compliant surface eliminates the need for a complex and expensive two-layer marking member.

Specific embodiments of the invention will now be described in detail. These examples are intended to be illustrative, and the invention is not limited to the materials, conditions, or process parameters set forth in these embodiments. All parts are percentages by weight of total solids as defined above unless otherwise indicated.

EXAMPLES

Example 1

Preparation of Fluoroelastomer Compounds and Dispersions

A fluoroelastomer (VITON® GF gum stock) and crosslinking agent (VC-50 curative) were obtained from DuPont. Nano-sized zinc oxide powder was obtained from NanoPhase Technology Corporation. An amount of 100 grams of VITON® GF gum stock was mixed with 50 grams of ZnO by using a two-roll rubber mill until ZnO was well dispersed in VITON® GF.

Solution #1 was prepared as follows: an amount of about 54 grams of the above solution was mixed with 246 grams of MiBK (methyl isobutyl ketone) by paint-shaking overnight.

Solution #2 was prepared by dissolving 54 grams of VITON® GF in 246 grams of MiBK.

Solution #3 was prepared by dissolving 10 grams of VC-50 in 30 grams of methyl ethyl ketone (MEK).

Example 2

Preparation of Cured Fluoroelastomer Films

TABLE 1

| Sample ID | Solution #1 (g) | Solution #2 (g) | Solution #3 (g) | Total (g) | ZnO in film (pph) |
|---|---|---|---|---|---|
| 2A | 0 | 85.00 | 3.06 | 88.06 | 0.0 |
| 2B | 12.14 | 72.86 | 2.91 | 87.91 | 5.0 |
| 2C | 23.17 | 61.77 | 2.78 | 87.72 | 10.0 |

VITON® GF films 2A, 2B and 2C were prepared by casting the dispersions in a mold, and slow drying overnight. This was followed by heating at 50 and 75° C. for 1 hour, then 95, 145, 175 and 205° C. each for 2 hours, and finally, 232° C. for 16 hours to cure the films. The resulting elastomer films were about 10-mil thick.

Example 3

Determination of Percentage Extractable In the Fluoroelastomer Film

About 2 grams of films 2A, 2B and 2C were cut from the large piece of films and exact initial weight for each small film was determined. Each film was then soaked in excess MEK in a bottle for 24 hours. The soaked film was then removed from the bottle, and dried at 120° C. for more than 2 hours. The weight of the dried film was measured. The percent extractable of each sample was calculated: percent extractable=100×(initial weight−dried weight after soaking)/initial weight. The lower the percent extractable, the more the crosslinked material was present in the film. The results are shown in the following Table 2:

TABLE 2

| Sample ID | ZnO (pph) | Percent extractable |
|---|---|---|
| 2A | 0 | 41.3 |
| 2B | 5.0 | 2.1 |
| 2C | 10.0 | 0.9 |

The percent extractable data indicate that the nano-size ZnO improves curing of fluoroealstomer significantly by allowing more crosslinking to occur in the film, hence the lower percent extractable. The results suggest that ZnO can replace the conventional basic metal oxides in the curative package.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A process for providing a layer on an offset printing member, wherein said offset printing member comprises a phase change ink component for applying a phase change ink in a phase change ink image, and an imaging member for accepting the phase change ink image from the phase change ink component, and transferring the phase change ink image from the imaging member to the print medium, the process comprising:

a) dissolving a fluoroelastomer;

b) adding and reacting a nano-size zinc oxide and a crosslinking agent, to form a resulting homogeneous fluoroelastomer dispersion, wherein said nano-size zinc oxide has a particle size of from about 24 to about 71 nanometers; and c) subsequently providing at least one layer of the homogeneous fluoroelastomer dispersion to said imaging member.

2. A process for providing a layer on a marking member comprising;

a) dissolving a fluoroelastomer;

b) adding and reacting a nano-size zinc oxide and a crosslinking agent, to form a resulting homogeneous fluoroelastomer dispersion, wherein said nano-size zinc oxide has a particle size of from about 24 about 71 nanometers; and c) subsequently providing at least one layer of the homogeneous fluoroelastomer dispersion to said imaging member.

3. The process in accordance with claim 2, wherein said nano-size zinc oxide is added in an amount of from 1 to about 50 pph of the fluoroelastomer.

4. The process in accordance with claim 3, wherein said amount is from about 5 to about 10 pph of the fluoroelastomer.

5. The process in accordance with claim 2, wherein said fluoroelastomer is selected from the group consisting of a) copolymers of vinylidenefluoride, hexafluoropropylene, and tetrafluoroethylene, b) terpolymers of vinylidenefluoride, hexafluoropropylene and tetrafluoroethylene, and c) tetrapolymers of vinylidenefluoride, hexafluoropropylene, tetrafluoroethylene, and a cure site monomer.

6. The process in accordance with claim 5, wherein the fluoroelastomer comprises 35 weight percent of vinylidenefluoride, 34 weight percent of hexafluoropropylene, 29 weight percent of tetrafluoroethylene, and 2 weight percent cure site monomer.

7. The process in accordance with claim 2, wherein said crosslinking agent is added in an amount of from about 0.5 to about 20 pph.

8. The process in accordance with claim 7, wherein said crosslinking agent is added in an amount of from about 1 to about 10 pph.

9. The process in accordance with claim 2, wherein said crosslinking agent comprises a bisphenol material and a phosphonium salt.

10. The process in accordance with claim 9, wherein said crosslinking agent comprises a bisphenol material in an amount of from about 0 to about 90 percent by weight of total solids.

11. The process in accordance with claim 10, wherein said crosslinking agent comprises a bisphenol material in an amount of from about 10 to about 70 percent by weight of total solids.

12. The process in accordance with claim 9, wherein said crosslinking agent comprises a phosphonium salt in an amount of from about 10 to about 100 percent by weight of total solids.

13. The process in accordance with claim 12, wherein said crosslinking agent comprises a phosphonium salt in an amount of from about 20 to about 70 percent by weight of total solids.

14. The process in accordance with claim 9, wherein said phosphonium salt is a benzyltriphenyl phosphonium bisphenol salt.

15. The process in accordance with claim 2, wherein during a), said fluoroelastomer is dissolved in a solvent selected from the group consisting of methyl ethyl ketone and methyl isobutyl ketone.

16. The process in accordance with claim 2, wherein following c), the fluoroelastomer is heat cured.

17. The process in accordance with claim 2, wherein said at least one layer of the homogeneous fluoroelastomer dispersion to said marking member has a percent extractables of from about 0.1 to about 3 percent.

* * * * *